United States Patent [19]

Kirby

[11] 4,297,938

[45] Nov. 3, 1981

[54] ELECTRONIC TUNING AID WITH DIGITAL READOUT

[76] Inventor: Archie D. Kirby, 4170 N. Marine Dr., Chicago, Ill. 60613

[21] Appl. No.: 74,674

[22] Filed: Sep. 12, 1979

[51] Int. Cl.[3] ..... G10G 7/02

[52] U.S. Cl. ..... 84/455; 84/DIG. 18; 250/231 R

[58] Field of Search ..... 84/454, 455, 464 R, 84/DIG. 18, DIG. 19; 324/77 K, 175; 356/25; 250/231 R, 232, 237 R, 239; 332/3; 235/201 FS, 201 PF

[56] References Cited

U.S. PATENT DOCUMENTS

| | | | |
|---|---|---|---|
| 3,144,802 | 8/1864 | Faber | 84/454 |
| 3,565,532 | 2/1971 | Heitmann | 250/232 |
| 3,722,353 | 3/1973 | Westhauer | 84/454 |
| 3,766,818 | 10/1973 | Prohofsky | 84/454 |
| 4,018,124 | 4/1977 | Rosado | 84/454 |
| 4,023,462 | 5/1977 | Denov | 84/454 |
| 4,028,985 | 6/1977 | Merritt | 84/454 |
| 4,061,071 | 12/1977 | Cameron | 84/455 |

FOREIGN PATENT DOCUMENTS

| | | | |
|---|---|---|---|
| 2301257 | 7/1974 | Fed. Rep. of Germany | 84/455 |

*Primary Examiner*—L. T. Hix
*Assistant Examiner*—Stafford D. Schreyer
*Attorney, Agent, or Firm*—Callard Livingston

[57] ABSTRACT

An electronic tuning aid with luminous digital readout adapted by structural and functional features to be operational by placement on the body of string and musical instruments such as the guitar. A shiftable photoelectric probe constituting a unitized component of the device is of an optical character uniquely sensitive to both damped and undamped string vibration of slight amplitude to activate included solid-state counting and translating components affording a numeric display of the frequency of individually selected strings. Steel strings are automatically driven in sustained vibration by an electromagnetic drive system affecting only the selected string and timed by such string in a feedback circuit with the probe.

11 Claims, 4 Drawing Figures

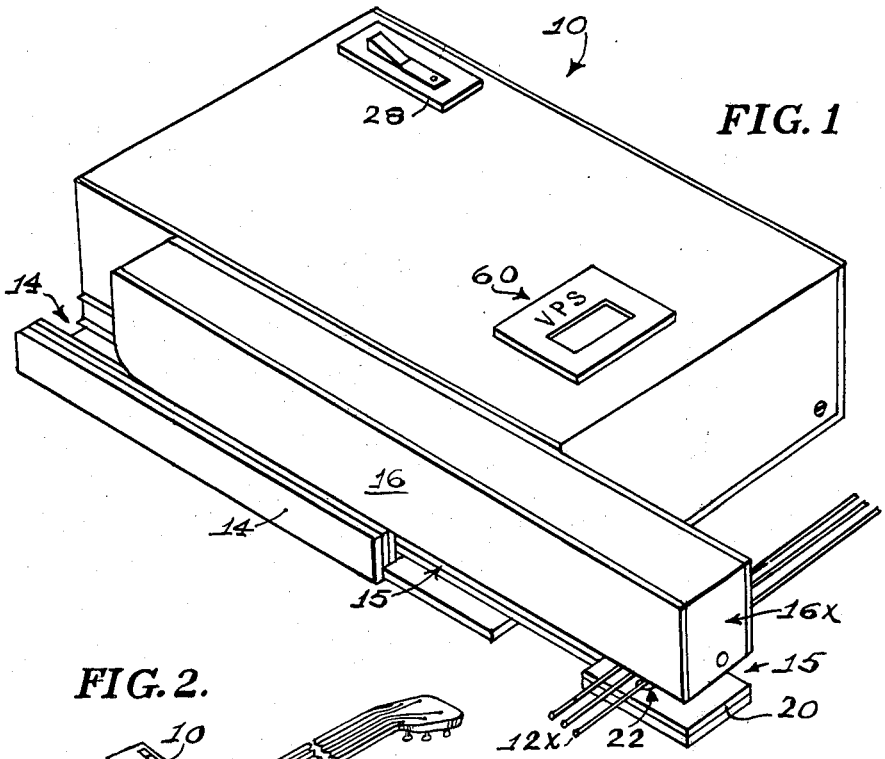
FIG. 1
FIG. 2.
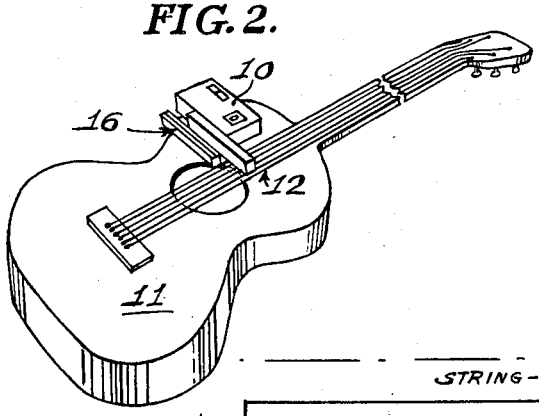
FIG. 3
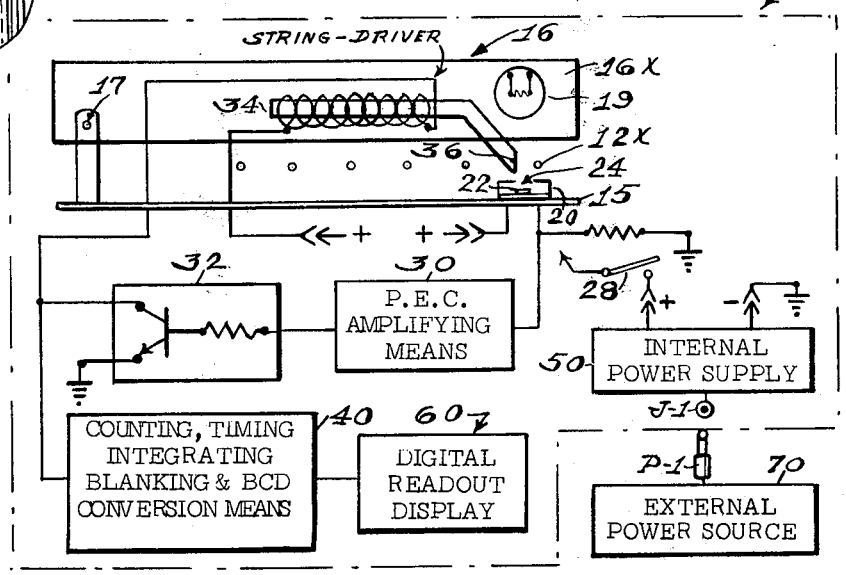

I
PROBE AMPLIFIER-DRIVER
II
TIMING AND DIFFERENTIATING MEANS
III
DIGITAL COUNTER
IV
DECODING & DISPLAY MEANS
V
BLANKING CIRCUIT
VI
INTERNAL POWER SUPPLY

ELECTRONIC TUNING AID WITH DIGITAL READOUT

The invention relates to apparatus for sensing and indicating musical pitch, and more particularly to that form thereof which is intended for use in tuning musical instruments, the present improvements affording a small electronic frequency-determining and indicating device having unique structural and functional features especially adapting it to be operational by placement on the body of a stringed instrument, such as the guitar, with competence to sense and display the frequency of individual strings in digital form.

Apparatus proposed heretofore for related purposes is unsuited to the objectives and incapable of the performance afforded by the disclosed device for reasons such as excessive bulk, mode of use, difficulty of application to the musical instrument, and the complex character of the circuit arrangements commonly relied upon with regard particularly to the transducing methods employed for deriving an analogue pitch or tone signal capable of actuating visual indicating means as, for example, in prior systems such as referred to hereafter which rely upon microphone input and its vulnerability to ambient noise, along with the necessity for operation thereof in conjunction with a source of reference frequency and some variation of comparator, discriminator, beat-frequency or peak-sensing technique for actuation of one or another arrangement of blinking, steady state, or null lamp means to indicate resonance or the tuned state.

An electronic tuning aid in accordance with the invention comprises a photoelectric pitch-sensing probe which is immune to environmental noise and constitutes a shiftable component of a compact unitary housing containing the entire apparatus, and of a character to be operational by placement on the body of an instrument such as a guitar, and including digital readout subcircuit components activated by photoelectric sensing means contained within the probe and utilizing an elongated optical slit oriented lengthwise of the string for obturation by a lengthwise portion thereof when vibrating, together with included amplifying, counting, timing and translating subcircuit components providing a numeric display of string frequency responsive to string vibration of only slight amplitude, whether diminishing in the damped mode or sustained as in the undamped mode.

In accordance with a further aspect of the invention, the probe includes electromagnetic means for driving steel strings automatically in sustained vibration by pulsed driving flux emanating from the pole piece of an electromagnetic source disposed in close juxtaposition with whichever string the probe is sensing, the electromagnetic source being part of a reflex circuit arrangement responsive to the photoelectric current modulations effected by the driven string.

The foregoing and other aspects of novelty and utility characterizing the device will appear in greater detail in the following specification of a preferred form thereof taken in view of the annexed drawing in which:

FIG. 1 is a perspective view of the complete tuning unit with instrument strings shown fragmentally in operative relation thereto;

FIG. 2 is a perspective view of the device disposed in operative position on an instrument such as a guitar;

FIG. 3 is a general functional diagram of structural and circuit components shown in part schematically and in part by block diagram;

Figure 4:
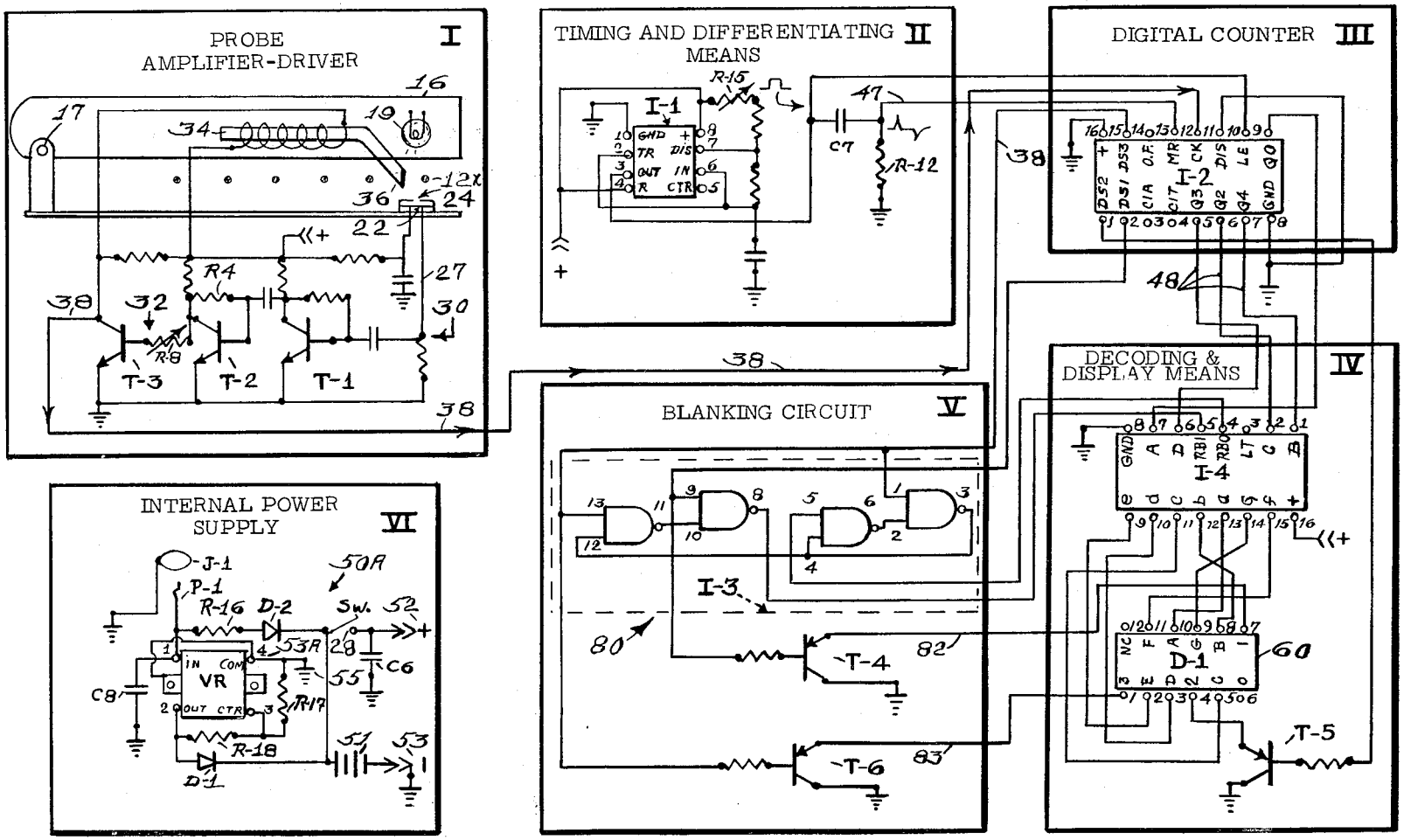
FIG. 4 is a detailed circuit schematic.

A preferred form of construction of the device, as depicted in FIG. 1, comprises a unitary housing 10 sufficiently small to rest by placement on the resonating body 11 of a stringed musical instrument, such as the guitar illustrated in FIG. 2, in a position alongside the usual complement of strings 12 which in some intruments may, as a matter of choice, be of the steel type or in other instruments may be of natural gut or synthetic material.

Provided as a unitized component along one side of the housing or encasement 10 is a probe bed 14 in which is slideably seated the base portion 15 of a chambered probe arm 16 pivotally supported thereon as at 17 to enable the arm to swing upwardly above the strings for positioning thereover while the lower base portion slides beneath the strings in positioning the sensing head 16X at the free end of the arm in overlying juxtaposition with some particular string 12X as in FIGS. 1 and 3.

Disposed on the outer end of the slideable base portion 15 directly beneath the sensing head 16X is a small chambered pad 20 adapted to underlie the selected string and containing a light-sensitive element 22, which may be a cadmium sulphide type of photoresistor, connected in a sensing circuit to be described, and adapted to be excited by light from a small lamp source 19 situated as shown in FIG. 3 in the head portion 16X, such light being admitted to the pad through a very narrow and elongated optical slit aperture 24 formed in a cover plate for the pad and having a width which optimally does not exceed the diameter of the string, and oriented to extend in a direction parallel to the length of the strings for an optimum distance, for example about three-sixteenth (3/16) of an inch, such that the total open area of the slit when obstructed is substantial relative to its width to admit an optimal amount of light notwithstanding its narrow lateral dimension, with regard also for the dimensional limitations imposed by the small space available for placement of the probe.

When placed on the guitar, with reference to FIGS. 2 and 3, the probe is positioned relative to some selected string 12X such that in its quiescent state the string lies outwardly of and along one side of, but very close to one edge margin of the slit aperture, so as to admit the maximum amount of source light for excitation of the relatively small photocell, the movements of the string when vibrating being effective to obscure the slot in accordance with amplitude and rate thereof and vary the cell excitation accordingly with modulation of the photoelectric current at whatever rate the string is tuned to.

The described optics of the probe means afford a highly sensitive reponse to very slight string displacement owing to the lengthwise extent of the aperture as against its lateral restriction and the photosensitive area to be affected, in relation to the thickness of the strings, and the effective lengthwise extent thereof available to reduce the open area significantly by even slight string movement beyond the margin of the slit, with consequent advantages in that vibration of little amplitude, as when the vibratory motion is diminishing progressively in damped vibration, will be effective to actuate the readout means even when the sound is no longer detachable by the ear, in consequence of which a readout of appreciable duration will be produced even if a string is plucked only one, this being an important advantage since many instruments will not employ the magnetically-attractable type of string responsive to the electromagnetic driving means. Satisfactory results are obtainable with an aperture width ranging between 0.031 and 0.008 inch, the latter being smaller than the diameter of the smallest string commonly used, and a preferred width where ambient light is strong.

Continuing with reference to FIG. 3, the fluctuations of the string-modulated photoelectric current effectuated by the described probe means, are amplified and converted into shaped pulses by the indicated photoelectric (PEC) Amplifying Means 30 providing square-wave output pulses as current analogues of the string vibrations which are then further amplified by Driving Transistor Means 32 (T-3) connected to energize the coil of the string-driving electromagnet 34, such pulses also being utilized to activate associated frequency readout subcircuit components included within the device and collectively represented by Block 40 in FIG. 3 to include solid state counting, integrating, timing, blanking and binary conversion and translating means actuating a 3-digit luminous readout unit, as indicated in Block 60, and situated on the top wall of the unit housing 10, FIG. 1.

Operating power for the apparatus is self-contained and derived primarily from an Internal Power Supply 50 in the form of a battery source indicated schematically at 50A in FIG. 4, and preferably comprising rechargeable batteries of the nickel-cadmium type accommodated within the housing 10 (not seen) and cooperative with an internal voltage-regulating circuit means and distributing network to be described hereafter, both effectively terminating in a jack J-1 accessible on a wall portion of the housing (not seen) for optional plug-in connection with an external source of Auxiliary Operating and Charging Power 70.

In use, with further reference to FIG. 3, the operation of the device is such that when the unit is disposed in operative position on the musical instrument, as described above, and assuming such instrument is equipped with steel strings, the selected string relative to which the probe has been positioned will begin to vibrate automatically the moment the master operating switch 28 is moved to the "ON" position owing to the provision of appropriate bias voltage operative in the PEC Amplifier system to maintain the Driving Transistor T-3 in conductive state in the absence of string movement in order to energize the driver coil 34, as will more fully appear, in consequence of which the quiescent string will be deflected at once when the switch is turned on, with the result that the Driving Transistor turns off and the string is relaxed, this process continuing with the string driving means operating as a form of oscillator deflecting and releasing the string in step with the vibratory displacements thereof occurring at the rate at which the string happens to be tuned, with reflexive variation of the driving flux from the pole piece 36.

More detailed aspects of the foregoing circuit arrangements are depicted in FIG. 4 wherein the several subcircuit components described generally in view of FIG. 3 are grouped for convenient reference in functional blocks designated I through VI, Block I reproducing the probe components shown in FIG. 3 in accompaniment with circuit details of the PEC Amplifying Means 30.

The light-modulated output from photocell 22 is applied via conductor 27 as input to cascaded amplifying transistors T-1 and T-2 and the driving transistor T-3 (also indicated generally at 32) to provide square-wave output pulses at a level suitable for energization of the string-driving means 34. A variable resistor R-8 in the base circuit of T-3 affords a calibrating control for the operating bias of this transistor effective in the "ON" condition of switch 28 to set the quiescent string vibrating automatically, as previously explained, and effective to adjust the pulse output in step with string displacement and fluctuation of the PEC input. This adjustment also operates to clip stray light signals and amplifier noise when the string is not vibrating.

The pulse output from driving transistor T-3 is also applied via conductor 38 to clock a 3-digit binary coded decimal counter I-2 in Block III, which may be an McMOS low power complementary BCD counter of the MC14553 type with internal latch means, low-frequency scanning clock, and multiplexing means, serving as a frequency counter cooperatively with timing and differentiating means, as shown in Block II, and comprising a timer I-1 of the 555 or Mc1555 type to supply triggering and resetting pulses for the counter cooperatively with differentiating network means C-7, R-12.

The Binary Count of I-2 is translated to digital equivalent by application of the counter outputs via conductors 48 to a Binary Decoding and Driving Means I-4, as shown in Block IV, which may be in the form of a BCD to 7-segment decoder-driver of the 7448 type, the outputs of which are supplied to a luminous readout display unit 60, such as an NSN33 or a DL33B type of DIP multiplexing readout located on the unit housing 10 and affording a 3-digit LED display, also designated D-I, Block IV.

Unwanted zeros to the left of the significant digits, which would otherwise appear automatically in such a readout system, are suppressed by means of a blanking circuit, such as depicted in Block V, comprising a 2-input position NAND gate 80 of the 7400 type with internal connections as shown and blanking outputs extended via transistors T-4 and T-6, and conductors 82 and 83 to the display unit 60.

For practical use with instruments such as the guitar, it is sufficient to provide a readout capacity of only three significant figures with omission of fractional values, since it is virtually impossible to tune the usual instrument of this class closer than 1 Hz to any given frequency, and the range of the usual complement of strings will not require more than the three-digit capacity provided, it being understood nevertheless that the competence of the photoelectric sensing means is entirely adequate to permit expansion of the readout capacity to include fractional values as well as an extended digit range for use with other types of stringed instrument of greater or different frequency range.

Space is provided within the unit housing 10 (not shown) to accommodate five small series-connected nickel cadmium battery cells of the AA type, indicated schematically at 51 in FIGS. 3 and 4 and affording a nominal terminal voltage of 6.25 volts, constituting the normal source of working power for completely portable use.

The internal battery 51 is connected as shown in Block VI, FIG. 4, to float across an internal voltage-regulating and charging circuit governing the voltage level of the battery source as well as that of an auxiliary external operating source indicated at 70 in FIG. 3 and of a type capable of delivering rectified DC for connection by plug and jack means P-1, J-1, FIG. 3, the jack being accessible on the rear side of the unit housing 10 (not seen) and having its tip contact, FIG. 4, connected via limiting resistor R-16 and diode D2 and the master control switch 28 to the system bus terminal indicated at 52, and also connected to the input terminal 1 of an integrated voltage regulating circuit unit VR with output extended from regulator terminal "OUT" via diode D1 to said terminal 52, the negative terminal of the battery being connected to the common terminal 4 of the regulator at 53A. The regulator VR may be of the uA78MGT2C type.

Control voltage for the regulator is derived from a voltage divider R17-R18 shunted across the system bus terminals at 53A, 55, the diode D2 blocking feedback of battery power directly to the input jack J-1 but passing current from the external source, if and when plugged in, to the extent governed by limiting resistor R16. A storage capacitance C6 of about 33 mfd. is shunted across the system terminals, and a stabilizing capacitance C8 of about 10 mfd. is connected across the regulator input. The internal power network will thus have the advantage of supplying requisite working voltage when any conventional external source of rectified DC of appropriate voltage (not shown) is plugged into jack J-1, for example when the device is required to operate over long periods, in which case charging current will be supplied concurrently to the battery to the extent of its acceptance from time to time; or, with the tuning aid turned off, a depleted battery may be brought up to charge whenever necessary, the voltage being regulated and overcharge avoided in each case.

Calibration of the device is easily checked and quickly adjustable by exposing the photocell through the slit aperture directly to light from a lamp powered by the usual a.c. utility lines at 60 Hz or other known line frequency and observing the readout. If this readout is different from 120, correction can be made by adjustment of variable resistor R15, Block II.

I claim:

1. Compact portable apparatus for use in sensing and displaying in digital terms the frequency of musical instrument strings vibrating in either damped or undamped mode, and comprising in accordance with the invention:

(a) a housing for placement on the instrument in adjacency to a complement of strings thereon;

(b) a vibration sensing probe constituting a movable part of said housing and having a sensing head positionable relative to any selected string of the complement;

(c) said head having respectively overlying and opposite underlying parts adapted to straddle the selected string, one of said parts including a light source and the other opposite part including optical slit means positioned such that the selected string will vibrate crosswise of the slit and substantially along the length thereof and modulate the source light accordingly;

(d) photosensitive means positioned relative to said slit means such that it is activated by the string-modulated source light;

(e) first circuit means in said housing activated by said photosensitive means to produce frequency analogue signals from said string-modulated source light;

(f) further circuit means in said housing converting said signals into digital control signals;

(g) display means carried by said housing and activated by said digital control signals to provide a luminous readout of the sensed string frequency in digital notation;

(h) said probe including electromagnetic string-driving means having a winding traversed by string-modulated photoelectric current and a salient pole piece producing a string-vibrating flux varying with the existing sensed string frequency located and disposed in driving adjacency to the selected string as an incident to operative placement of the sensing head relative to such string, whereby magnetically responsive strings will be driven in sustained vibration at whatever sensed frequency the string happens to be tuned.

2. A tuning aid of the photoelectric type for use with stringed musical instruments wherein the vibration of a selected string modulates a light source and photoelectric sensing and circuit means provided a visual indication of some aspect of the rate of the string displayed as a visual readout, characterized: in that a photoelectric sensor means is contained in a sensing head constituting part of a motile probe which is a movable component of an emplacement housing small in size and of configuration suitable for emplacement upon the body of the musical instrument, said head including a light source and photoelectric vibration sensor means spaced therefrom to admit therebetween for free vibration however vibrated whether plucked or power driven, a string selected by adjustment of said probe to position said head relative thereto, said sensing head further including optical aperture means in the form of an elongated slit of a width approximating the width of the string to be sensed and of a length many times greater than such width and interposed between the selected string and said sensor means in a particular orientation consequent upon adjustment of the probe as aforesaid, whereby the length of the slit is in substantially parallel alignment with a lengthwise portion of the string on a side thereof such that the string vibrates into the area of the slit to modulate source light and produce an analogue vibration signal, together with electronic digital readout display means carried by said housing for displaying a readout of ambient string frequency in digital numeric notation, and readout sub-circuit means responsive to said analogue signals to activate said readout display means.

3. An electronic tuning aid as defined in claim 2 further characterized in that said probe comprises an arm structure housing said photoelectric sensor, aperture means and light source, together with means mounting the arm structure for movement relative to the housing and disposition in sensing relation with a selected string as aforesaid.

4. Apparatus as set forth in claim 3 further characterized in that said mounting means disposes said arm structure for sliding movement relative to the housing in a direction laterally of the length of the complement of strings for disposition relative to a selected string as aforesaid.

5. Apparatus according to claim 3 wherein said probe arm structure comprises two sections, one upper and one lower and spaced apart vertically such that the upper section is adapted to overlie the string complement including the selected string, and the lower section is adapted to lie beneath said strings, the light source being located in one said section and the photoelectric sensor in the other said section on the opposite side of the selected string from said source, said aperture means being interposed between the string and photoelectric sensor for modulating obturation by vibratory movements of the selected string.

6. Apparatus according to claim 5 further characterized in that said aperture means comprises a narrow elongated slit orientated with its length paralleling a corresponding lengthwise portion of the selected string such that vibration of the selected string tends to block and clear the entire lengthwise and crosswise area of the slit for optical modulation effects and sensitivity to string vibration of even slight amplitude.

7. A tuning aid according to claim 5 further characterized in that that one of said arm sections which is adapted to overlie the string complement, as aforesaid, is pivotable relative to the other section enabling clearance of the string complement and facilitating the selective positioning of the probe relative to the desired string.

8. Apparatus according to claim 2 wherein said probe includes an electromagnetic string driving means operative to drive magnetically-attractable strings in sustained vibration at the tuned rate thereof, said driving means including a pole piece located to lie at one side of the selected string when the probe is oriented in sensing position as aforesaid, together with an activating winding connected for pulsed energization in synchrony with the string-modulated sensing current.

9. An electronic tuning aid according to claim 2 wherein said readout subcircuit means comprises an amplifying subcircuit responsive to said modulated sensing current and producing shaped sensing pulses representative of the rate of string vibration; timing and differentiating subcircuit means responsive to said pulses and connected to drive binary digital counting means in timed counting cycles to produce an output representative of the frequency of string vibration; and translating subcircuit means including binary coded decimal conversion means connected to translate the binary count into an equivalent digital count; and luminous digital display means responsive to said digital count to display the string frequency in digital form.

10. Apparatus according to claim 9 further characterized by the provision of a blanking subcircuit cooperative with said digital counting means and said display means to suppress unwanted digital zeros otherwise appearing at the left of significant frequency digits in said digital frequency display.

11. A unitary device for indicating the frequency of vibration of a sound-producing string comprising: a photoelectric probe structure positionable adjacent the string and including spaced members adapted in positioning as aforesaid to straddle the string, one said member including a light source directing light onto the string and the other said member including a photoelectric sensor operative to produce sensing current variations representative of the rate of vibration of the spring motion in the path of said light; aperture means interposed between the string and photoelectric sensor defining an elongated light-transmitting slit of narrow width extending in the direction of the length of the string such that the lengthwise extent of the aperture is several times greater than the crosswise width thereof whereby vibratory movement of the lengthwise portion of the string relative to the aperture will obturate a substantial area of the aperture in maximum amplitude of vibration and appreciable portions of such area at lesser marginal amplitudes including those near and below the threshold of audibility for average normal hearing with capability of producing modulated sensing current as aforesaid in both ranges; together with circuit means connected for control by said sensing modulations and operative in both ranges of amplitude aforesaid to provide a visual display of the rate in vibrations per second of a vibrating string with respect in which the probe is positioned as aforesaid.

* * * * *

UNITED STATES PATENT AND TRADEMARK OFFICE

CERTIFICATE OF CORRECTION

PATENT NO. : 4,297,938

DATED : November 3, 1981

INVENTOR(S) : Archie D. Kirby

It is certified that error appears in the above-identified patent and that said Letters Patent are hereby corrected as shown below:

In the Specification: Column 2, line 38 "obstructed" should read --unobstructed--; lines 66, 67 "detachable" should read --detectable--; Column 6, line 21 (Claim 2), "provided" should read --provides--; Column 8, line 38 (Claim 11), "in" should read --to--.

Signed and Sealed this

*Ninth* Day of *February 1982*

[SEAL]

*Attest:*

GERALD J. MOSSINGHOFF

*Attesting Officer*

*Commissioner of Patents and Trademarks*